US005305064A

United States Patent [19]

Trott et al.

[11] Patent Number: 5,305,064

[45] Date of Patent: Apr. 19, 1994

[54] COMPACT SINGLE COMPONENT DEVELOPMENT SYSTEM WITH MODIFIED TONER AGITATOR AND TONER DISPENSE AUGER DISPOSED THEREIN

[75] Inventors: Robert E. Trott, Webster; Lawrence Floyd, Jr., Rochester; John F. Knapp, Fairport, all of N.Y.

[73] Assignee: Xerox Corporation, Stamford, Conn.

[21] Appl. No.: 64,250

[22] Filed: May 20, 1993

[51] Int. Cl.[5] ..... G03G 15/06

[52] U.S. Cl. ..... 355/260; 222/DIG. 1; 355/245; 355/257

[58] Field of Search ..... 355/245, 259, 260, 298; 222/DIG. 1, 228, 240, 241, 413, 412; 406/55, 138, 155

[56] References Cited

U.S. PATENT DOCUMENTS

| | | | |
|---|---|---|---|
| 3,240,401 | 3/1966 | Kirschmann | 222/412 X |
| 3,275,196 | 9/1966 | Warczak | 222/412 X |
| 4,173,405 | 11/1979 | Swapceinski et al. | 355/260 |
| 4,825,244 | 4/1989 | Hediger | 355/245 |
| 4,926,217 | 5/1990 | Bares | 355/253 |
| 5,012,287 | 4/1991 | Knapp | 355/259 X |
| 5,047,806 | 9/1991 | Brewington et al. | 355/259 |
| 5,118,013 | 6/1992 | Mutou et al. | 222/DIG. 1 |
| 5,177,538 | 1/1993 | Mammino et al. | 355/259 |
| 5,187,524 | 2/1993 | Cherian | 355/260 |
| 5,189,475 | 2/1993 | Fournia et al. | 355/246 |
| 5,200,787 | 4/1993 | Nishiguchi | 355/298 |
| 5,235,389 | 8/1993 | Kikuchi et al. | 355/260 |
| 5,245,392 | 9/1993 | Behe et al. | 355/259 |

FOREIGN PATENT DOCUMENTS

| | | | |
|---|---|---|---|
| 1034957 | 3/1956 | Fed. Rep. of Germany | 406/55 |

*Primary Examiner*—Matthew S. Smith
*Attorney, Agent, or Firm*—Oliff & Berridge

[57] ABSTRACT

An electrophotographic apparatus in which toner particles are moved from the toner hopper or dispenser cartridge to the developer housing and onto the donor roller in a single component development system for use in color reprographic systems. A rotating holey tube toner agitator is modified to incorporate structure or grooves on the outer peripheral surface. Further, by placing a shrouded toner dispense auger inside the holey tube, the development system architecture stays compact and improved toner powder pushing through the pre-load of toner on the donor roller results, thereby insuring delivery of fresh toner evenly across the length of the developer housing. With more efficient pre-load, agitator rotational speed and bias can be reduced, leading to less toner effluents emanating from the developer housing without adversely affecting the cycle to cycle donor roller toner reload.

8 Claims, 4 Drawing Sheets

COMPACT SINGLE COMPONENT DEVELOPMENT SYSTEM WITH MODIFIED TONER AGITATOR AND TONER DISPENSE AUGER DISPOSED THEREIN

BACKGROUND OF THE INVENTION

1. Field of the Invention

This invention relates to an electrophotographic image forming apparatus, and more particularly to a developer housing for compact single component development systems with modified toner agitator and a shrouded dispense auger disposed inside a holey tube for use in color reprographic systems.

2. Description of Related Art

In general, an electrophotographic printing machine requires a photoconductive member that is charged to a substantially uniform potential so as to sensitize the surface thereof. The charged portion of the photoconductive member is thereafter exposed to a light image of an original document to be reproduced. Exposure of the charged photoconductive member selectively dissipates the charge thereon in the irradiated areas. This records an electrostatic latent image on the photoconductive member corresponding to the informational areas contained within the original document being reproduced. Alternatively, in a printing application, the electrostatic latent image may be created electronically by exposure of the charged photoconductive layer by an electronically controlled laser beam. After recording the electrostatic latent image on the photoconductive member, the latent image is developed by bringing a developer material charged of opposite polarity into contact therewith. In such processes, the developer material may comprise a mixture of carrier particles and toner particles or toner particles alone. Toner particles are attracted to the electrostatic latent image to form a toner powder image which is subsequently transferred to a copy sheet and thereafter permanently affixed to the copy sheet by fusing.

In the foregoing type of printing machine, a development system is employed to deposit developer material onto the electrostatic latent image recorded on the photoconductive surface. Generally, the developer material comprises toner particles adhering triboelectrically to coarser carrier granules. Typically, the toner particles are made from a thermoplastic material while the carrier granules are made from a ferromagnetic material.

Alternatively, a single component magnetic material may be employed. A system utilizing a single component developer material, such as disclosed herein, is capable of high speeds, thus, a single component developer system readily lends itself to applications involving high speed electrophotographic printing machines. However, a large continuous supply of toner particles must be available to be capable of copying large numbers of original documents or producing multiple copies of the same original document. This is necessary to insure that the machine is not shut down at relatively short intervals due to the lack of toner particles. Ideally, this is achieved by utilizing a remote toner sump containing a large supply of toner particles positioned remotely from the developer housing in the printing machine. The toner particles are then transported from the toner sump to the development system.

Notably, it has been found that it is frequently difficult to locate the toner sump within the printing machine while still optimizing the printing machine architecture. This is due to the need for multiple color housings and the fact that the toner particles do not readily move against the gravitational force. Hence the toner sump is typically positioned above the development system. Under these circumstances, this restricts the machine architecture. Further, it is highly desirable to be capable of developing a latent image with insulating, non-magnetic toner particles. Insulating toner particles (i.e., for color reprographics) optimize copy quality, however, the problem of transporting these toner particles from a remote location must be overcome.

Further, since toner material is consumed in a development process and must be periodically replaced within a development system to sustain continuous operation of the machine, various techniques have been used in the past to replenish such toner supply. Initially, new toner material was added directly from supply bottles or containers by pouring into the dispensing apparatus fixed in the body of the reprographic machine. The addition of such gross amounts of toner material altered the triboelectric relationship between the toner and the carrier in the developer resulting in reduced charging efficiency of the individual toner particles and accordingly in reduction of the development efficiency when developing the latent image on the image bearing surface. In addition, the pouring process was both wasteful and dirty in that some of the toner particles became airborne and would tend to migrate into the surrounding area and other parts of the machine.

Accordingly, separate toner or developer hoppers with a dispensing mechanism for adding the toner from the hopper to the developer apparatus in the automatic machines on a regular or as needed basis have been provided. In addition, it is a common practice to provide replenishing toner supplies in a sealed container which, when placed in the printing machine, can be automatically opened to dispense toner. In such systems, the developer may be dispensed from the container relatively uniformly, although difficulty may arise in uniformly dispensing the developer since a large mass of toner particles (which frequently are somewhat tacky) may tend to agglomerate (i.e., become compacted) and form a bridging structure in the toner container.

Additionally, with the use of removable or replaceable developer cartridges, and due to the relative high cost of the developer contained therein, it is desirable to remove as much of the developer as possible during the dispensing operation from the cartridge so that only a minimal quantity of developer is not dispensed for use in the formation of images. Excessive quantities of developer undispensed and remaining in an empty developer cartridge increase the cost per copy to the consumer.

For electrophotographic purposes, composite development systems are known. For instance, U.S. Pat. No. 4,926,217 to Bares, discloses an apparatus for moving toner particles from one end of a duct to the other end with means provided to fluidize the particles in the duct and means to generate a pressure differential to move the fluidized particles in the duct from one end to the other.

U.S. Pat. No. 5,187,524 to Cherian, discloses a helical spring auger for transporting developer from a toner dispenser cartridge to an entrance to the developer housing, or from a cleaning station adjacent the photoreceptor to a waste bottle.

U.S. Pat. No. 5,189,475 to Fournia et al., discloses a toner concentration sensor that is located adjacent a transport auger within the developer sump for use with a two component development system.

While the above described developer mechanisms provide for movement of toner particles in a transporting conduit, the do not do so in a fully effective manner.

SUMMARY OF THE INVENTION

It is thus an object of the invention to provide an improved apparatus for moving toner particles to the developer housing sump of a single component development system and to provide a stable and consistent toner layer to the donor roll on every cycle, thereby enabling consistently high quality color reprographics.

It is an object of the invention to provide a compact single component development system with modified toner agitator and toner dispense auger disposed therein for use with color reprographic systems that requires no more space within the electrophotographic printing machine architecture than the development system it replaces.

It is another object of the invention to provide a shrouded toner dispense auger inside the holey tube toner agitator to assist in delivery of fresh toner evenly across the length of the developer housing.

It is still another object of the invention to provide structure or grooves on the outer peripheral surface of the holey tube toner agitator such that improved powder pushing through the preload of toner on the donor roller occurs. This will enable more efficient toner reload, can reduce agitator speed and bias, thereby reducing the amount of toner effluents emanating from the developer housing, without adversely affecting the cycle to cycle donor roller toner reload.

To enable long term stability and reliability in single component development systems, it is imperative that toner be introduced into the developer housing sump, or chamber, in a manner that circumvents the problems of powder mixing discussed above. That is, the toner powder must be introduced uniformly along the entire length of the developer housing.

During development of the invention, the durability of a development system incorporating the inventive design architecture described herein, was tested. The tested design architecture employed a phenolic donor roller for development, an elastomeric toner metering blade for toner uniformity on the donor roller surface, and a holey tube toner mover that served the dual purpose of both transporting toner along the length of the developer housing and providing toner delivery and premetering fields necessary for the preloading of the donor roller in the developer housing chamber. The single component toners were typically low melt polyester toners in the 7 to 8 micron particle size range.

As a result of testing, it was determined that much of the long term stability problems associated with single component development systems were, in fact, related to toner flow and the method of toner introduction to the developer housing chamber. It was further noted, that while the holey tube was quite efficient for the task of bringing toner up into the development nip, it was not adequate during high speed reprographic operations (i.e., stressed conditions) in particular, for the task of moving toner laterally across the length of the developer housing. Thus, the process was faced with a dilemma. That is, at speeds necessary to sustain adequate preload of the donor roller and the chamber, toner flow in the holey tube is diminished. To boost toner flow the speed of the toner mover can be reduced, but pre-load will suffer.

It was also noted during testing, that after a representative time period, toner on the donor roller surface did not develop off onto the photoreceptor efficiently, thereby resulting in a non-uniform patch end to end. Further, at the end closest to the toner feed, it was discovered that best development resulted. Thus, it was discovered that oppositely signed toner was being left behind in the chamber after development. This oppositely signed toner then reacts with correctly signed toner thereby causing at least some electrostatic agglomeration of the toner material which further inhibited its ability to flow in the chamber.

Additionally, it was discovered that when toner was introduced into the developer housing chamber from an end feed position, the toner never thoroughly mixed with toner that is several inches away from the feed position in the chamber. This is due to the fact that unlike a liquid which has turbulence and therefore, is capable of promoting easy mixing between two mixable fluids, a powder does not exhibit these properties without extraordinary help. In particular, toner particles tend to move down the length of the developer housing chamber like a travelling slug if unassisted and thus, limited mixing is possible.

Having determined that it is necessary to introduce toner into the developer housing across its entire length in order to achieve proper mixing, the solution was an auger dispense tube that fits into the housing and is small enough to fit inside the existing holey tube toner agitator (i.e., compact). In a preferred embodiment, a flat wire spiral auger is used.

Other objects, advantages and salient features of the invention will become apparent from the detailed description, which taken in conjunction with the annexed drawings, discloses preferred embodiments of the invention.

BRIEF DESCRIPTION OF THE DRAWINGS

Referring now to the drawings which form part of this original disclosure.

DETAILED DESCRIPTION OF THE PREFERRED EMBODIMENTS

Figure 1:
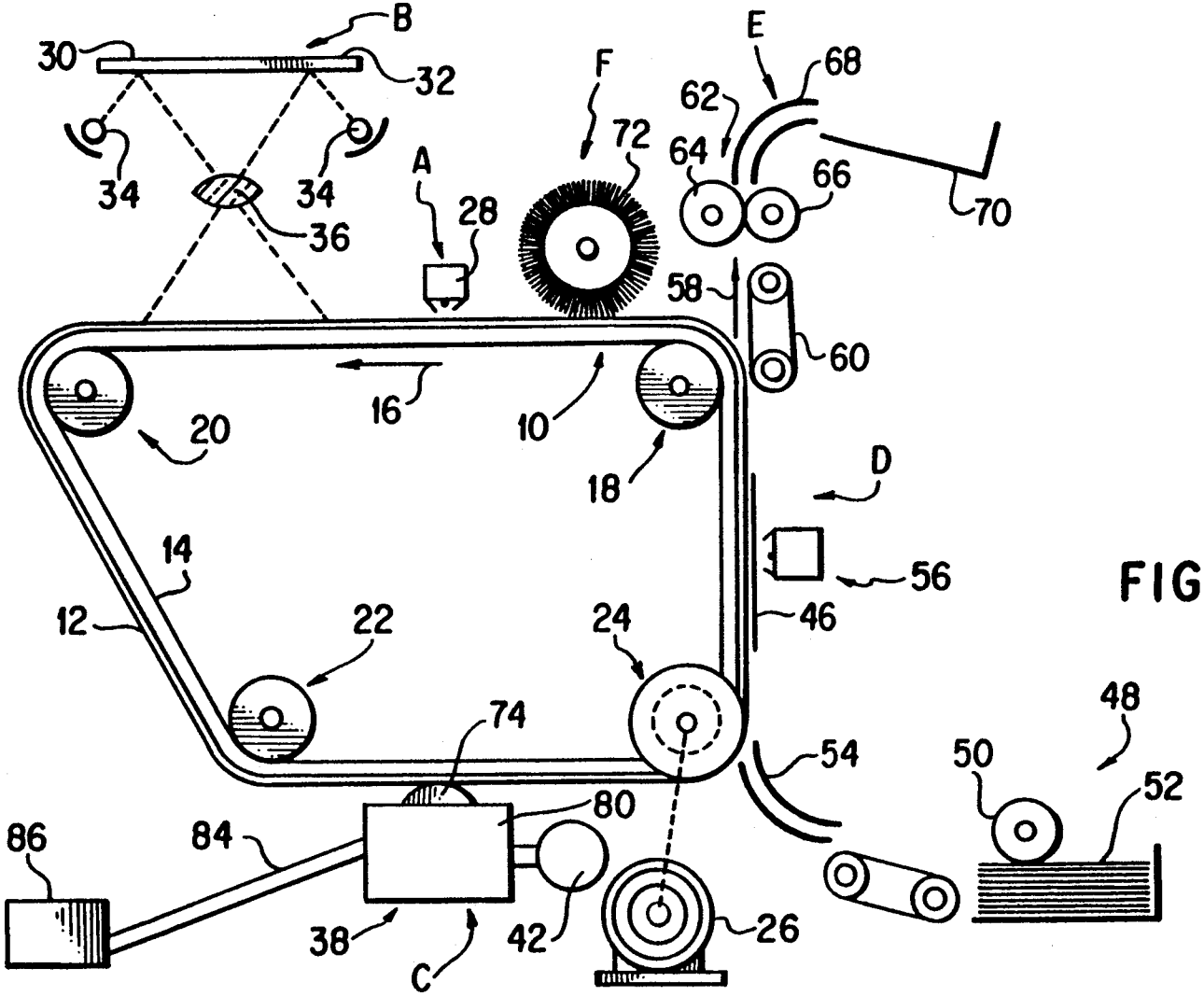
FIG. 1 is a schematic elevational view depicting an electrophotographic printing machine incorporating the development apparatus of the present invention therein.

For a general understanding of the features of the invention, reference is made to the drawings. In the drawings, like reference numerals have been used throughout to designate identical elements. FIG. 1 schematically depicts the various elements of an illustrative electrophotographic printing machine incorporating the development system and toner particle transport of the invention therein. Inasmuch as the art of electrophotographic printing is well known, the various processing stations employed in the FIG. 1 printing machine will be shown hereinafter schematically and their operation described briefly with reference thereto.

Turning now to FIG. 1, the electrophotographic printing machine employs a belt 10 having a photoconductive surface 12 deposited on a conductive substrate 14. Preferably, photoconductive surface 12 is made from a selenium alloy with conductive substrate 14 being made from an aluminum alloy which is electrically grounded. Other suitable photoconductive surfaces and conductive substrates may also be employed. Belt 10 moves in the direction of arrow 16 to advance successive portions of photoconductive surface 12 through the various processing stations disposed about the path of movement thereof. As shown, belt 10 is entrained by rollers 18, 20, 22 and 24. Roller 24 is coupled to motor 26 which drives roller 24 so as to advance belt 10 in the direction of arrow 16. Rollers 18, 20 and 22 are idler rollers which rotate freely as belt 10 moves in the direction of arrow 16.

Initially, a portion of belt 10 passes through charging station A. At charging station A, a corona generating device 28, charges a portion of photoconductive surface 12 of belt 10 to a relatively high, substantially uniform potential.

Next, the charged portion of photoconductive surface 12 is advanced through exposure station B. At exposure station B, an original document 30 is positioned face down upon a transparent platen 32. Lamps 34 flash light rays onto original document 30. The light rays reflected from original document 30 are transmitted through lens 36 forming a light image thereof. Lens 36 focuses the light image onto the charged portion of photoconductive surface 12 to selectively dissipate the charge thereon. This records an electrostatic latent image on the photoconductive surface 12 which corresponds to the informational areas contained within original document 30 disposed upon transparent platen 32. Thereafter, belt 10 advances the electrostatic latent image recorded on photoconductive surface 12 to development station C.

Figure 2:
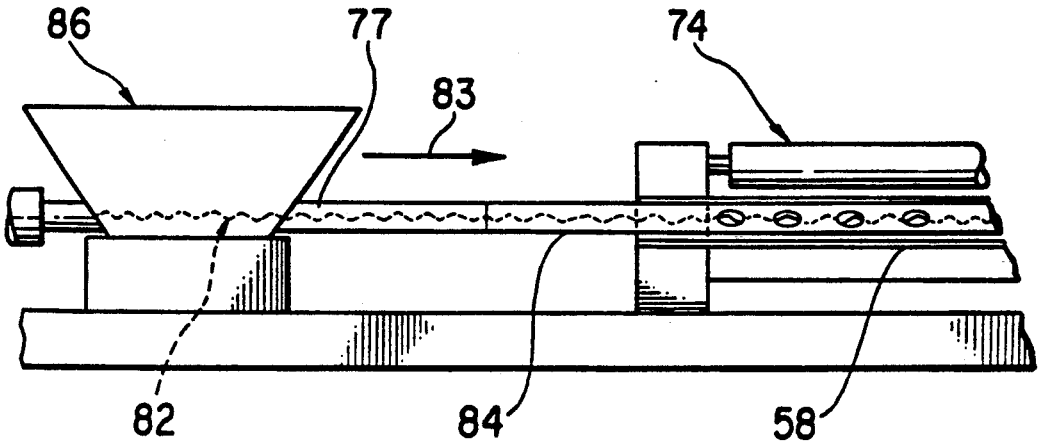
FIGS. 2 and 3 are fragmentary, sectional elevational views depicting the transport of toner particles from the toner hopper to and through the developer housing in accordance with the invention.
Figure 3:
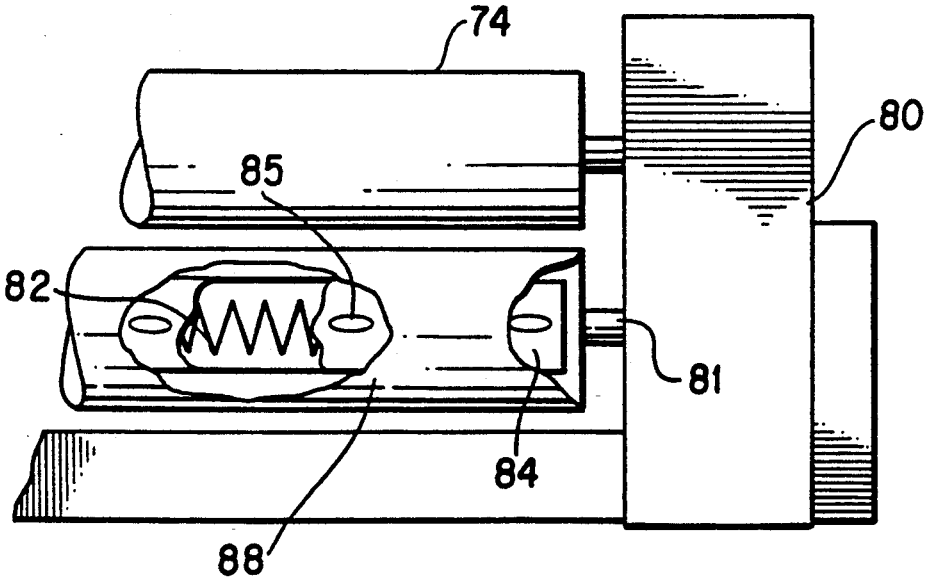

At development station C, a magnetic brush development system, indicated generally by the reference numeral 38, transports a single component developer material comprising toner particles into contact with the electrostatic latent image recorded on photoconductive surface 12. Toner particles are furnished to development system 38 from a remote toner container (or hopper) 86. Blower 42 (which may be provided, but is not essential for the preferred embodiment described herein) maintains the pressure in the housing of development system 38 at a lower pressure than the pressure in remote toner hopper 86. Stationary drop tube 84 couples remote toner hopper 86 to the housing 80 of development system 38 (although not shown, the toner hopper 86 may be positioned at a height above development system 38). Auger 82 (see FIGS. 2 and 3) is mounted inside the stationary drop tube 84 and causes toner particles to be advanced from remote toner hopper 86 to and across housing 80 of developer system 38. Developer system 38 forms a brush of toner particles which is advanced by donor roller 74 into contact with the electrostatic latent image recorded on photoconductive surface 12 of belt 10. Toner particles are attracted to the electrostatic latent image forming a toner powder image on photoconductive surface 12 of belt 10 so as to develop the electrostatic latent image. The detailed structure of developer system 38 will be subsequently described with reference to FIGS. 2–8, inclusive.

After development, belt 10 advances the toner powder image to transfer station D. At transfer station D, a sheet of support material 46 (e.g., paper) is moved into contact with the toner powder image. Support material 46 is advanced to transfer station D by a sheet feeding apparatus, indicated generally by the reference numeral 48. Preferably, sheet feeding apparatus 48 includes a feed roll 50 contacting the uppermost sheet of the stack of sheets 52. Feed roll 50 rotates to advance the uppermost sheet from stack 52 into chute 54. Chute 54 directs the advancing sheet of support material 46 into contact with photoconductive surface 12 of belt 10 in a timed sequence so that the toner powder image developed thereon contacts the advancing sheet of support material at transfer station D.

Transfer station D includes a corona generating device 56 which sprays ions onto the backside of sheet 46. This attracts the toner powder image from photoconductive surface 12 to sheet 46. After transfer, the sheet continues to move in the direction of arrow 58 onto a conveyor 60 which moves the sheet to fusing station E.

Fusing station E includes a fuser assembly, indicated generally by the reference numeral 62, which permanently affixes the powder image to sheet 46. Preferably, fuser assembly 62 includes a heated fuser roller 64 and a backup roller 66. Sheet 46 passes between fuser roller 64 and a backup roller 66 with the toner powder image contacting fuser roller 64. In this manner, the toner powder image is permanently affixed to sheet 46. After fusing, chute 68 guides the advancing sheet to catch tray 70 for subsequent removal from the printing machine by the operator.

Invariably, after the sheet of support material is separated from photoconductive surface 12 of belt 10, some residual toner particles remain adhering thereto. These residual particles are removed from photoconductive surface 12 at cleaning station F. Cleaning station F includes a pre-clean corona generating device (not shown) and a rotatably mounted fibrous brush 72 in contact with photoconductive surface 12. The pre-clean corona generator neutralizes the charge attracting the particle to the photoconductive surface. These particles are cleaned from the photoconductive surface by the rotation of brush 72 in contact therewith. Subsequent to cleaning, a discharge lamp (not shown) floods photoconductive surface 12 with light to dissipate any residual charge remaining thereon prior to the charging thereof for the next successive imaging cycle.

It is believed that the foregoing description is sufficient for purposes of the present application to illustrate the general operation of an exemplary electrophotographic printing machine incorporating the features of the invention therein.

Figure 4:
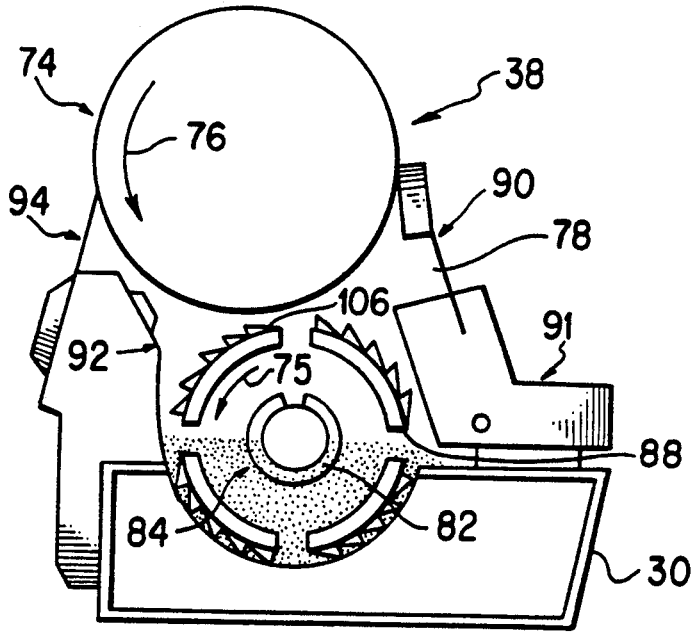
FIG. 4 is a schematic elevational view showing the inventive development apparatus used in the FIG. 1 printing machine.

Referring now to FIGS. 2–8, the detailed structure of development system 38 is shown thereat. The development system includes a donor roller 74. Donor roller 74 is preferably phenolic, but may be a bare metal such as aluminum. Alternatively, the donor roller 74 may be a metal roller coated with a material. For example, a polytetrafluoroethylene based resin such as Teflon®, a trademark of the Du Pont Corporation, or a polyvinylidene fluoride based resin, such as Kynar®, a trademark of the Pennwalt Corporation, may be used to coat the metal roller. This coating acts to assist in charging the particles adhering to the surface thereof. Still another type of donor roller may be made from stainless steel plated by a catalytic nickel generation process and impregnated with Teflon®. The surface of the donor roller is roughened from a fraction of a micron to several microns, peak-to-peak. An electrical bias is applied (by known means) to the donor roller. The electrical bias applied to the donor roller depends upon the background voltage level of the photoconductive surface, the characteristics of the donor roller, and the spacing between the donor roller and the photoconductive surface. It is thus clear that the electrical bias applied on the donor roller may vary widely. Donor roller 74 is coupled to a motor (not shown), as known in the art, which rotates donor roller 74 in the direction of arrow 76. Donor roller 74 is positioned, at least partially, in chamber 78 of housing 80. Also shown, see FIG. 4, is a metering blade 90 with blade holder 91, which ensures toner uniformity on the donor roller 74 surface. Additionally, reload flap 92 and chamber seal 94 are depicted, which help to reduce the amount of toner effluents emanating f rom the developer housing 80.

A stationary drop tube 84 connects remote toner hopper 86 to chamber 78 of housing 80. Toner particles stored in toner hopper 86 are advanced by auger 82, which is preferably a flat wire spiral auger, but may be a helical spring or other similar type auger as known in the art, in the direction of arrow 83 to and along the longitudinal axis of chamber 78 of housing 80. The stationary drop tube 84, which is preferably an elongated duct and tubular in shape, has an entrance region 77 in remote toner hopper 86 and extends into the chamber 78 to the far end 81 of housing 80. Similarly, auger 82, which extends through the remote toner hopper 86, is rotatably mounted inside stationary drop tube 84 and extends to and through chamber 78 of housing 80 to the far end 81 of housing 80. Auger 82 is coupled to a motor (not shown) which rotates auger 82 as necessary (in the range of about 30 rpm to 100 rpm) to move toner from the remote toner hopper 86 to and across the housing 80 (i.e., at a move rate of about 10 in/sec to 30 in/sec). Note that a portion of stationary drop tube 84 (i.e., that portion wholly disposed within the chamber 78) has a plurality of holes 85 disposed uniformly about a periphery of the stationary drop tube 84 which allow the toner to exit the stationary drop tube 84, and enter the chamber 78, evenly dispersed throughout stationary drop tube 84's length.

A holey tube 88 is rotatably positioned exterior to stationary drop tube 84 (i.e., the auger 82 and stationary drop tube 84 combination is arranged inside the rotating holey tube 88). Holey tube 88 rotates at an appropriate speed, sufficient to fluidize and agitate the toner particles, however, it imparts substantially no longitudinal movement to the toner particles. The fluidized toner particles move in the direction of arrow 83 due only to the action of auger 82. Holey tube 88 is mounted rotatably in the chamber 78 of housing 80 and extends under and along donor roller 74 to facilitate the preload of toner particles on donor roller 74 by agitation of the bed of toner particles delivered by auger 82 and stationary drop tube 84. Holey tube 88 is also coupled to a motor (not shown) with sufficient torque producing capacity to rotate the holey tube 88 at speeds of about 250 rpm to 500 rpm. The detailed structure of the holey tube member 88 will be described hereinafter with reference to FIGS. 5–8.

Figure 5:
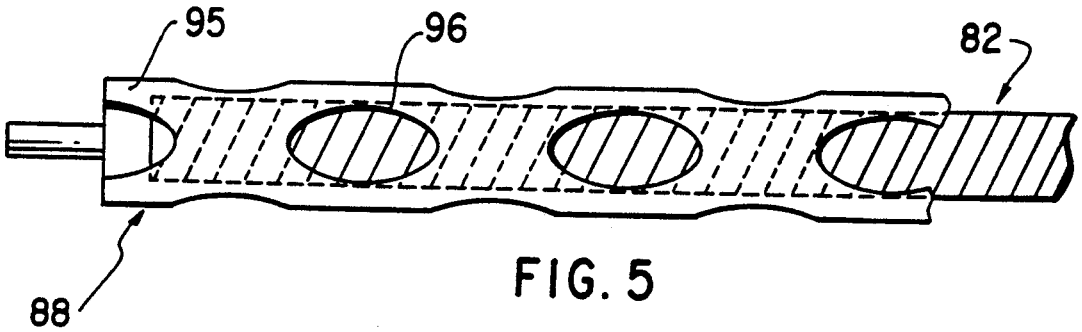
FIG. 5 is a schematic cross-sectional view of a toner dispense auger disposed within the holey tube toner agitator in accordance with the invention.

FIG. 5 shows the basic architecture of the holey tube 88 with the auger 82 disposed interior thereto (Note: the stationary drop tube 84, which shrouds auger 82, is not shown for ease of presentation). In particular, holey tube 88 comprises a hollow rod or tube 95 having equal rows of apertures or holes 96 therein. The rows of holes 96 are spaced about the periphery of the hollow tube 95 by about 90 degrees between rows. Each hole 96 in each row is spaced from the next adjacent hole. The holes are equally spaced from one another. In this way, as the holey tube 88 rotates, the holes therein cause the toner particles, delivered via the auger 82 and stationary drop tube 84, to be agitated and fluidized so as to facilitate their deposition on donor roller 74, as discussed above.

Figure 6:
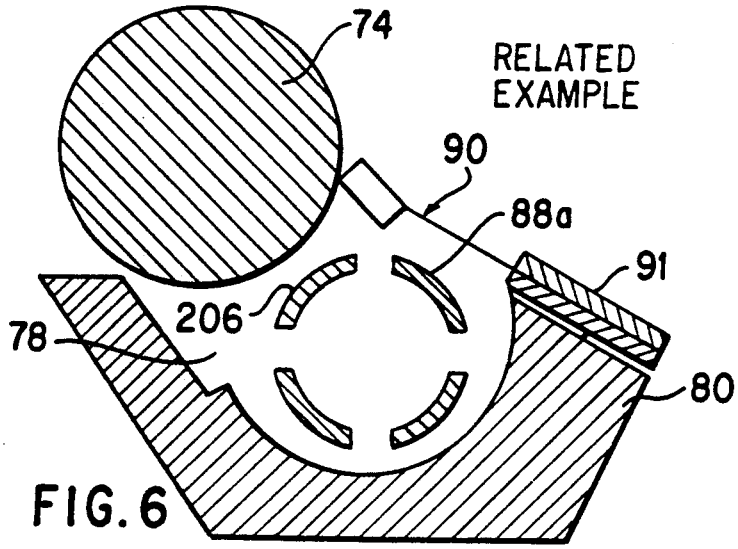
FIG. 6 is a schematic representation of a related smooth exterior holey tube agitator.
Figure 7:
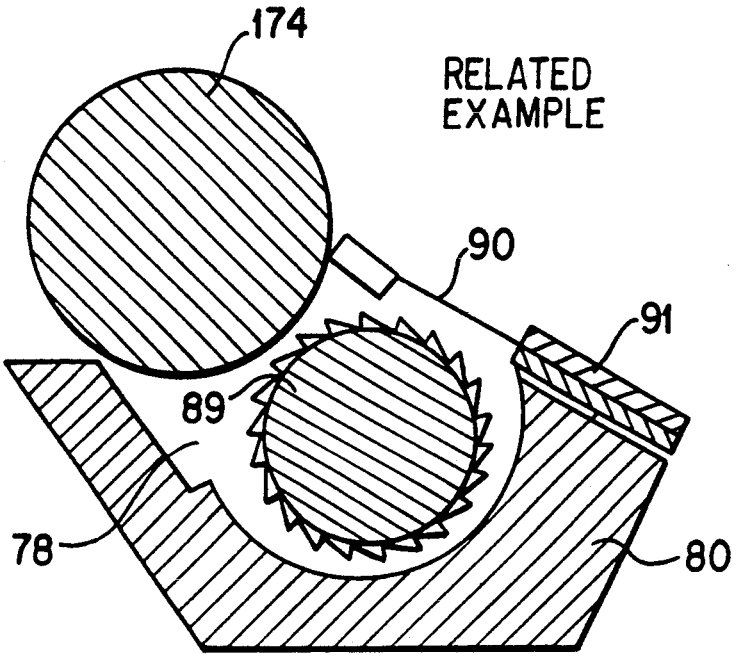
FIG. 7 is a schematic representation of a related solid star tube agitator.

FIGS. 6 and 7 show related examples of representative toner agitators disposed in chamber 78 of housing 80. Donor roller 74, metering blade 90 and blade holder 91 are also depicted. In particular, holey tube **88*a* is shown with a smooth outer surface 206. In FIG. 7, a solid star tube agitator 89*b* is substituted for the holey tube agitator 88*a* shown in FIG. 6**. Importantly, however, neither agitator is effective for use with the invention described herein.

Figure 8:
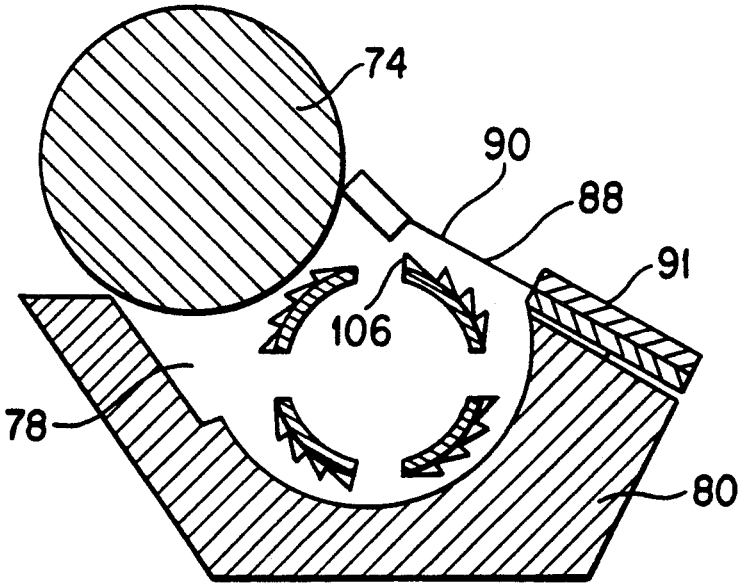
FIG. 8 is a schematic representation of a holey tube toner agitator that incorporates structure or grooves on the outer peripheral surface, in accordance with the invention.

FIG. 8 shows the holey tube 88 for use in the invention, which is a modification of holey tube **88*a* shown in FIG. 6 to the extent structure or grooves 106 are incorporated on the outer peripheral surface thereof. In this way, improved toner powder pushing and improved preload of toner on the donor roller 74 results. Thus, with more efficient preload, agitator speed and bias can be reduced leading to less toner effluents emanating from the developer housing 80 without affecting cycle-to-cycle donor roller 74** toner reload, as discussed above.

While the invention has been described in connection with the preferred embodiment, it will be understood that it is not intended to limit the invention to these embodiments. On the contrary, it is intended to cover all alternatives, modifications and equivalents as may be included within the spirit and scope of the invention as defined by the appended claims.

What is claimed is:

1. An apparatus arranged for use in an electrophotographic printing machine for moving single component toner particles from a toner storage container to a developer housing chamber and therein to provide means for immediate preload of toner particles onto a donor roller which transports the toner particles from the developer housing chamber to a photoreceptor, comprising:

a stationary drop tube connecting said toner storage container to said developer housing chamber and extending across said developer housing chamber where said stationary drop tube terminates at a side of said developer housing chamber farthest away from said toner storage container;

means for moving toner particles from the toner storage container to the developer housing chamber and laterally across the developer housing chamber along a longitudinal axis thereof, said moving means being rotatably mounted interiorly to said stationary drop tube;

an elongated member rotatably mounted in said developer housing chamber and positioned such that said stationary drop tube is disposed interiorly thereto and extending laterally across said developer housing chamber, said elongated member comprising a hollow rod having a plurality of apertures therein with said apertures being spaced apart uniformly and arranged in a plurality of rows, wherein said elongated member rotates during operation to fluidize the toner particles in the developer housing chamber, thereby enabling immediate pre-load of toner particles onto said donor roller.

2. The apparatus of claim 1, wherein the moving means comprises a toner dispense auger.

3. The apparatus of claim 2, wherein said auger further comprises at least one of a flat wire spiral auger and a helical spring auger.

4. The apparatus of claim 2, wherein said auger rotates during operation at a rate of about 30 rpm to 100 rpm.

5. The apparatus of claim 1, wherein the elongated member further comprises at least one of a plurality of radially extending blades disposed radially on an exterior surface of said hollow rod and a plurality of grooves cut in a radially outer surface of said hollow rod.

6. The apparatus of claim 1, wherein a portion of said stationary drop tube, disposed wholly within said developer housing chamber, comprises a plurality of apertures spaced apart along an outer periphery of said stationary drop tube to allow the toner particles moved from said toner storage container by action of said moving means, access to said developer housing chamber.

7. The apparatus of claim 1, wherein said elongated member rotates during operation at a rate of about 250 rpm to 500 rpm.

8. The apparatus of claim 1, wherein said moving means moves toner particles during operation at a rate of about 10 in/sec to 30 in/sec.

* * * * *